US012116853B2

(12) United States Patent
Wheater et al.

(10) Patent No.: US 12,116,853 B2
(45) Date of Patent: Oct. 15, 2024

(54) WIRELINE CASED-HOLE ROLLER

(71) Applicants: Guy Wheater, London (GB); Stuart Huyton, Moray (GB)

(72) Inventors: Guy Wheater, London (GB); Stuart Huyton, Moray (GB)

( * ) Notice: Subject to any disclaimer, the term of this patent is extended or adjusted under 35 U.S.C. 154(b) by 167 days.

(21) Appl. No.: 17/080,666

(22) Filed: Oct. 26, 2020

(65) Prior Publication Data

US 2022/0127920 A1 Apr. 28, 2022

(51) Int. Cl.
*E21B 23/14* (2006.01)
*E21B 17/10* (2006.01)

(52) U.S. Cl.
CPC ..... *E21B 23/14* (2013.01); *E21B 17/1057* (2013.01)

(58) Field of Classification Search
CPC ..... E21B 23/14; E21B 17/1057
See application file for complete search history.

(56) References Cited

U.S. PATENT DOCUMENTS 4,747,452 A * 5/1988 Clark ..... E21B 37/02 166/241.1
5,778,976 A * 7/1998 Murray ..... E21B 21/10 175/325.5
6,250,406 B1 * 6/2001 Luke ..... E21B 17/105 175/325.2
10,612,330 B2 * 4/2020 Wheater ..... E21B 23/12
2003/0042022 A1 * 3/2003 Lauritzen ..... E21B 33/1295 166/207
2005/0098353 A1 * 5/2005 Maxwell ..... E21B 17/1014 175/57
2008/0156477 A1 * 7/2008 Aivalis ..... E21B 41/0085 166/53
2012/0018145 A1 * 1/2012 Wheater ..... E21B 17/206 166/241.5
2012/0031609 A1 * 2/2012 Wheater ..... E21B 17/1057 166/241.5
2012/0255744 A1 * 10/2012 Shaikh ..... E21B 17/1057 166/241.1
2013/0333949 A1 * 12/2013 Simpson ..... E21B 17/1057 175/325.3
2014/0238659 A1 * 8/2014 Wheater ..... E21B 23/12 166/85.5
2014/0367169 A1 * 12/2014 Wheater ..... E21B 47/10 175/45
2019/0169976 A1 * 6/2019 Wheater ..... E21B 47/12
(Continued)

*Primary Examiner* — Tara Schimpf
*Assistant Examiner* — Neel Girish Patel
(74) *Attorney, Agent, or Firm* — Tumey L.L.P.

(57) ABSTRACT

The present invention relates to a wireline cased-hole roller (WCRO) for deployment during a logging operation that reduces slickline or e-line cable contact and drag in the cased hole section of a wellbore. Arrays of WCROs, clamped on the slickline or e-line, reduce logging tensions and improve force transmission from surface down to the tool cable head by significantly reducing the cased-hole cable drag. They also permit the use of lower grade cables or winches in certain environments due to lower logging tensions. Another benefit is the mitigation of cased hole cable wear zones since the cable is suspended above the casing, liner or tubing. In high-angle or horizontal wells, arrays of WCROs aid conveyance and improve tractor performance by reducing the cable drag force which has to be overcome to reach the target zone.

3 Claims, 5 Drawing Sheets

(56) References Cited

U.S. PATENT DOCUMENTS

| | | | | |
|---|---|---|---|---|
| 2019/0360274 | A1* | 11/2019 | Tian | E21B 10/62 |
| 2020/0339440 | A1* | 10/2020 | Riley | F22B 3/04 |
| 2021/0140253 | A1* | 5/2021 | Fuglestad | F16L 55/32 |
| 2022/0066066 | A1* | 3/2022 | Zeghlache | G01V 3/18 |
| 2022/0127920 | A1* | 4/2022 | Wheater | E21B 17/10 |
| 2022/0195803 | A1* | 6/2022 | Cramer | E21B 7/06 |
| 2022/0220807 | A1* | 7/2022 | McDonough | E21B 10/12 |

* cited by examiner

WIRELINE CASED-HOLE ROLLER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Invention

The present invention relates to the performance of wireline or slickline cable during logging operations of a subsurface wellbore. More particularly, the present invention relates to a device for use with a wireline or slickline cable to reduce cable contact and drag during logging operations.

Background of the Invention

Wireline logging is a common operation in the oil industry whereby down-hole tools are conveyed on wireline (also known as "e-line" in industry parlance) to acquire data or perform services in either the open-hole or cased-hole sections of a wellbore. Some of these cased-hole services can also be conducted by slickline. Data or services may be needed in wellbores comprising geometries with various curves, bends, and/or turns (e.g., doglegs) in the cased-hole section, the result of which may be casing or tubing wear due to the high cable drags generated or high surface tensions and limited overpull capacity for the tools.

Currently, during a logging operation, the wireline or slickline may experience high drag and high surface tension due to the curvatures of the cased-hole section of the wellbore. These conditions can contribute to damage and/or wear of both the wellbore and the wireline or slickline. For example, a cable experiencing high drag and high tension may damage a wellbore by cutting deep grooves into the casing or tubing. Casing or tubing grooves may compromise the structural integrity of the wellbore, and can be particularly problematic in wells requiring a minimum material thickness of tubing or casing to satisfy pressure testing. Additionally, a cable experiencing high drag and high tension may be subjected to significant wear-and-tear due to the increase in friction and force. Wear-and-tear of the wireline or slickline may be mitigated by using higher grade cables; however, such use often times incurs additional unwanted cost.

Furthermore, high drag and high-tension conditions may result in insufficient overpull capacity at surface and require a lighter tool-string or an alternate deployment method to conduct a job safely, such as setting a packer on tubing as opposed to wireline. In some wells, particularly in long extension high angle wells, wireline logging tools may utilize motorized devices such as tractors to push the tools downhole. However, a cable experiencing high drag due to the cased-hole curvatures in a wellbore may cause a tractor to run out of power before reaching a target zone. This is due to high cable drag that the tractor must overcome to push the tools along the wellbore and may require a higher power tractor to reach the target zone. When this occurs, the tractor may exhaust all power before delivering the logging tool to its target destination along the wellbore.

Consequently, there is a need for a cable mounted device for wireline or slickline operations to improve performance in tortuous cased-hole sections by reducing cable contact (casing and tubing wear), reducing cable drags and surface tensions, and improving tension transmission efficiency from surface to the logging tools.

BRIEF SUMMARY OF SOME OF THE PREFERRED EMBODIMENTS

These and other needs in the art are addressed in one embodiment by a wireline cased-hole roller (WCRO) comprising a pair of cable insert halves, a pair of opposing WCRO body halves, a pair of reciprocally-positioned chassis comprising a plurality of roller wheels, and one or more fasteners, wherein the one or more fasteners are configured to couple the pair of cable insert halves, the pair of opposing WCRO body halves, and the pair of chassis together onto a cable, wherein the shape of the WCRO in combination with the plurality of roller wheels allow for both radial and axial movement.

These and other needs in the art are addressed in one embodiment by a cable assembly comprising a cable, and a wireline cased-hole roller (WCRO), wherein the WCRO comprises: a pair of cable insert halves, a pair of opposing WCRO body halves, a pair of reciprocally-positioned chassis comprising a plurality of roller wheels, and one or more fasteners, wherein the one or more fasteners are configured to couple the pair of cable insert halves, the pair of opposing WCRO body halves, and the pair of chassis together onto the cable, wherein the shape of the WCRO in combination with the plurality of roller wheels allow for both radial and axial movement.

These and other needs in the art are addressed in one embodiment by a method for reducing cable drag and tension during wireline logging operations comprising coupling one or more wireline cased-hole rollers (WCROs) to a cable, wherein the one or more WCROs comprise: a pair of cable insert halves, a pair of opposing WCRO body halves, a pair of reciprocally-positioned chassis comprising a plurality of roller wheels, and one or more fasteners, wherein the one or more fasteners are configured to couple the pair of cable insert halves, the pair of opposing WCRO body halves, and the pair of chassis together onto the cable, wherein the shape of the WCRO in combination with the plurality of roller wheels allow for both radial and axial movement.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1A:
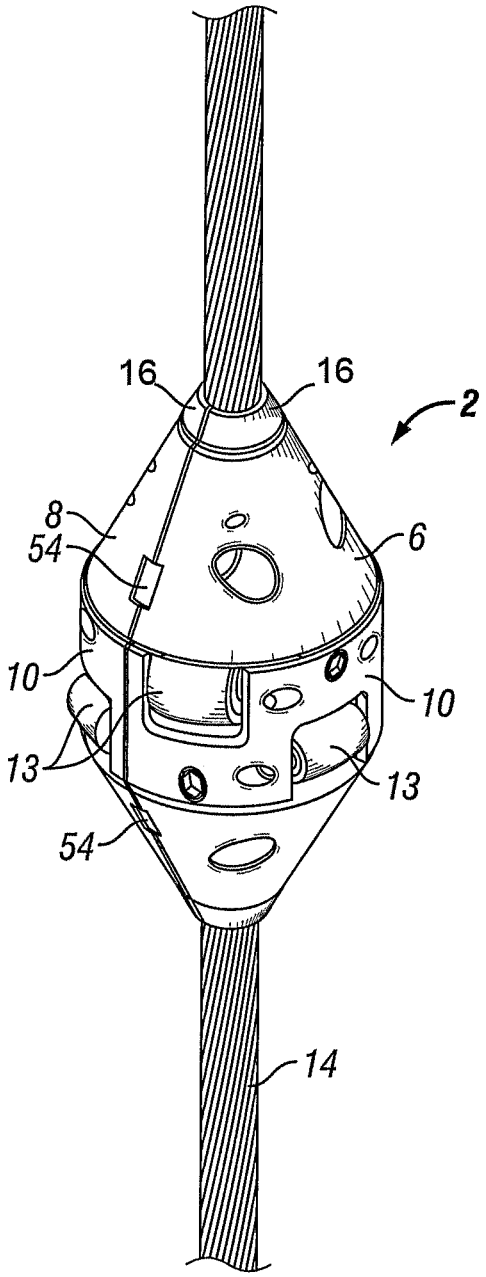
FIGS. 1A and 1B illustrate isometric views of a wireline cased-hole roller in accordance with one embodiment of the present invention.
Figure 1B:
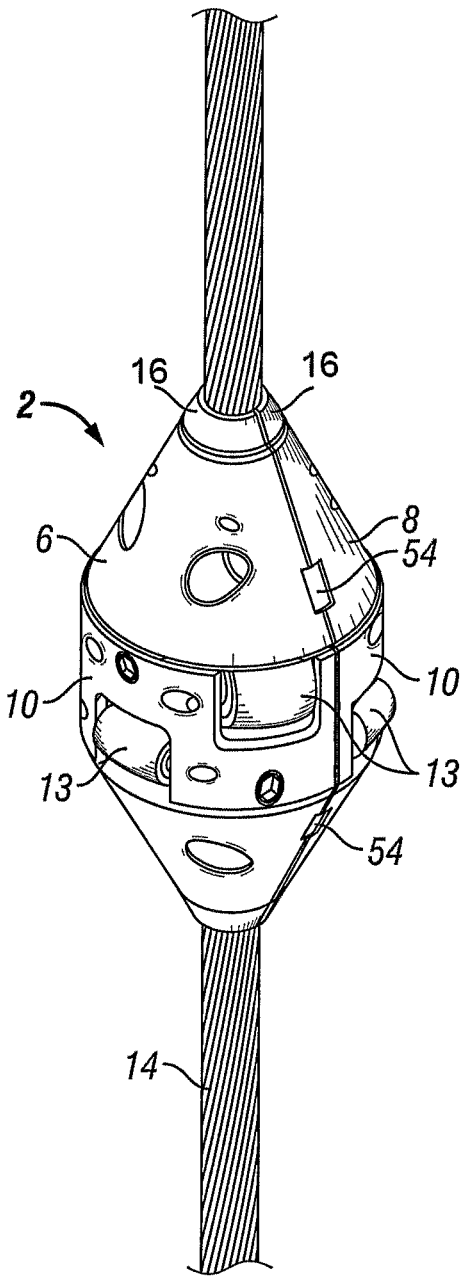

FIGS. 1A and 1B illustrate an embodiment of a wireline cased-hole roller (WCRO) 2. In embodiments, WCRO 2 may be a device for installation on a wireline or slickline cable above a wellbore logging tool, capable of significantly reducing cable drag in a cased-hole section of a subsurface wellbore. In reducing cable drag, WCRO 2 may reduce logging tensions and improve force transmission from wellbore surface to logging tool cable head during wireline logging operations. In embodiments, WCRO 2 comprises two cable insert halves 4, two opposing WCRO body halves (an upper body 6 and a lower body 8), two chassis 10, and a plurality of roller wheels 13. As illustrated, two cable insert halves 4, upper and lower bodies 6 and 8, two chassis 10, and plurality of roller wheels 13 may be fastened together onto a cable 14. In embodiments, cable 14 may be any suitable cable for use with any wellbore logging tool. As previously mentioned, cable 14 may be, without limitation, a wireline or slickline. Further, coupling of these components onto cable 14 may be accomplished using screws, bolts, anti-shear dowel pins, spigots, or any combinations thereof.

Figure 2A:
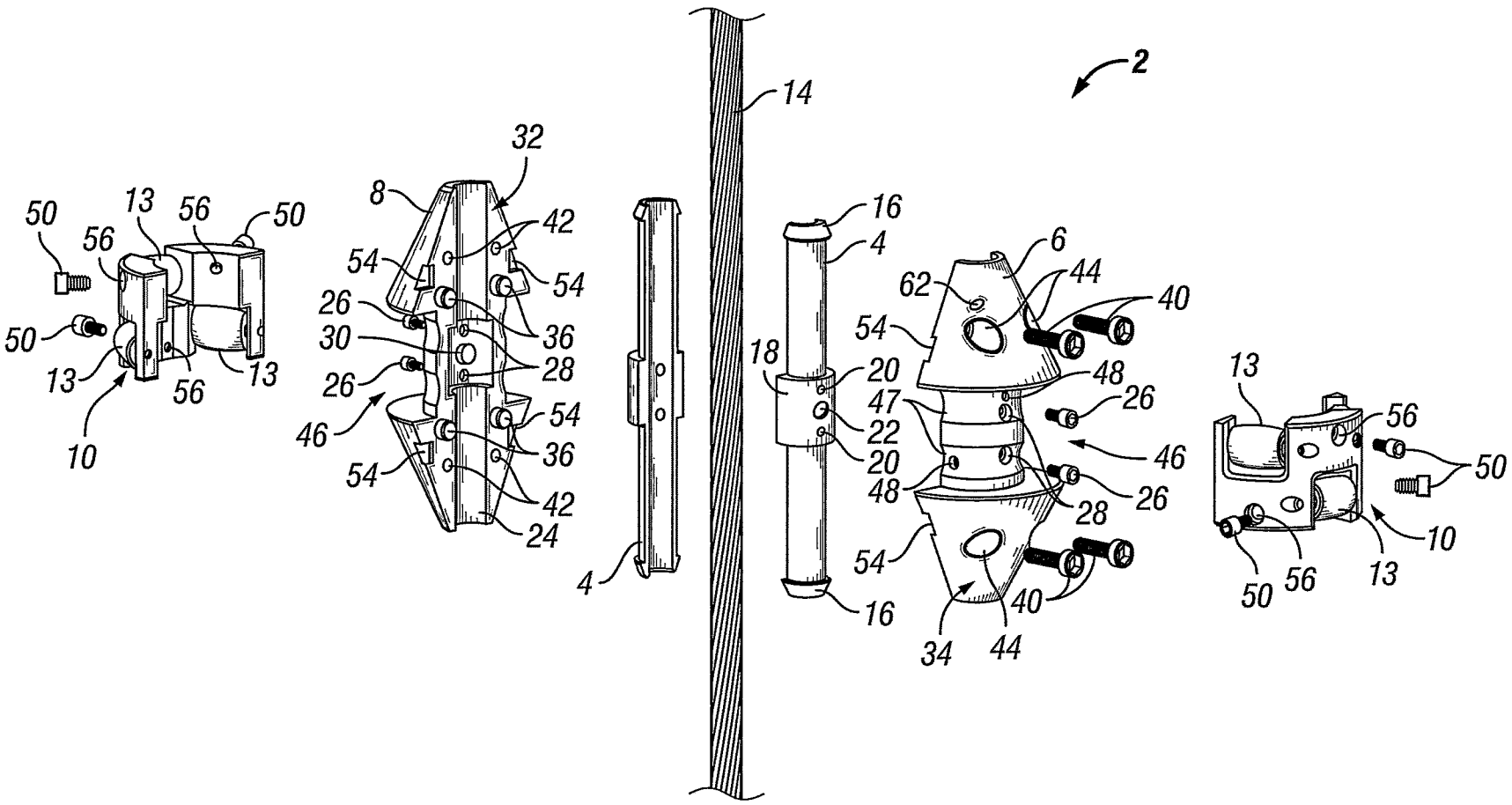
FIGS. 2A and 2B illustrate exploded views of a wireline cased-hole roller in accordance with one embodiment of the present invention from opposing perspectives.
Figure 2B:
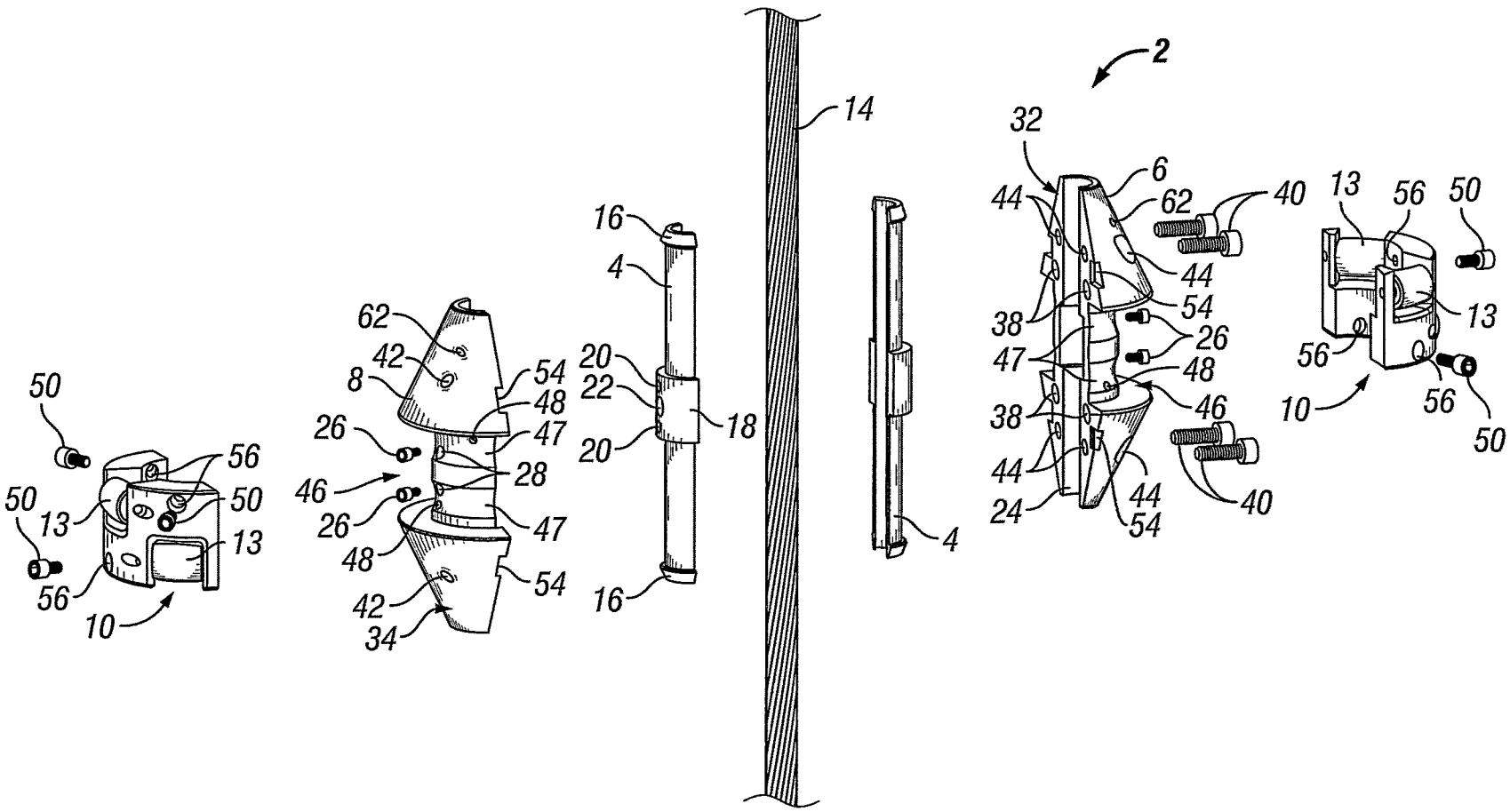

FIGS. 2A and 2B each illustrate an exploded view of WCRO 2 from opposing perspectives. As illustrated, cable insert halves 4 may be concentrically disposed between cable 14 and upper and lower bodies 6 and 8, such that cable insert halves 4 may be in direct contact with cable 14 and at least partially encased within upper and lower bodies 6 and 8. In embodiments, cable insert halves 4 may mate together to form a central bore in which to pass cable 14 through WCRO 2. Each cable insert half 4 may be in the general shape of a hollow, half cylinder and comprise flanged ends 16 disposed about the end portions of each cable insert half 4 and a central flange 18 disposed about the middle portion of each cable insert half 4. Flanged ends 16 and central flanges 18, alone or in combination, may be used to prevent axial movement of cable insert halves 4 within WCRO 2. In embodiments, flanged ends 16 may be tapered and between about 0.75 cm and about 1.5 cm in length to match the external cone profile of the WCRO 2. Further, flanged ends 16 may extend beyond upper and lower bodies 6 and 8, while the remaining portions of each cable insert half 4, including central flanges 18, may fit into corresponding cable insert recess portions 24 of upper and lower bodies 6 and 8. In embodiments, each central flange 18 may comprise one or more cable insert fastener threads 20 which receive one or more cable insert fasteners 26 and one or more anti-rotation spigot recesses 22 which receive one or more anti-rotation spigots 30. As illustrated, each cable insert half 4 may comprise two cable insert fastener threads 20 to correspond with two cable insert fasteners 26 and one anti-rotation spigot recess 22 to correspond with one anti-rotation spigot 30.

In embodiments, cable insert halves 4 may be available in various sizes to ensure the central bore diameter of WCRO 2 corresponds to the diameter of cable 14. In embodiments, cable 14 may vary in diameter between about 5.0 mm and about 20.0 mm. During installation of WCRO 2, cable insert halves 4 may be configured to slightly deform around an outer armor of cable 14 to prevent physical damage to the cable. To accomplish this deformity, cable insert halves 4 may be manufactured from any suitable material, such as, without limitation, aluminum and other soft metals. Further, cable insert halves 4 may be disposable. In embodiments, cable insert halves 4 may be manufactured from aluminum, and because aluminum may be considerably softer than the armor of cable 14, there may be a reduced risk of damage to the wireline or slickline during installation of WCRO 2. At installation, cable 14 may be any suitable diameter required for a particular logging operation and may even vary in diameter size along its length, taking into account any manufacturing tolerances and varying degrees of wear or distortion. Therefore, a range of different cable insert halves 4 may be employed for a plurality of WCROs 2 installed on cable 14 to ensure a proper fit along the length of cable 14 and prevent slippage on and/or damage to cable 14. In embodiments, the length of cable insert halves 4 may be between about 10.0 cm and about 20.0 cm, or alternatively between about 10.0 cm and about 15.0 cm.

As set forth above, cable insert halves 4 may be encased within the opposing WCRO body halves of upper and lower bodies 6 and 8. In embodiments, upper and lower bodies 6 and 8 may be of similar structure and in the general shape of a tapered half cylinder comprising an inner surface 32 and an outer surface 34. Inner surface 32 of both upper and lower bodies 6 and 8 may comprise cable insert recess portions 24 having anti-rotation spigots 30 and insert fastener clearance holes 28. In embodiments, insert fastener clearance holes 28 may extend from inner surface 32 to outer surface 34 of upper and lower bodies 6 and 8. In embodiments, cable insert recess portions 24 may be configured in shape to accurately receive cable insert halves 4, such that anti-rotation spigots 30 fit into anti-rotation spigot recesses 22, thus preventing radial rotation of cable insert halves 4 within WCRO 2. Further, cable insert halves 4 may be secured within cable insert recess portions 24 with cable insert fasteners 26, such that cable insert fasteners 26 may travel through insert fastener clearance holes 28 to be received by or fit into cable insert fastener threads 20, and sit flush with outer surface 34 of upper and lower bodies 6 and 8. In embodiments, cable insert fasteners 26 may be any suitable fasteners, bolts, or screws such as, without limitation, small cap head bolts or screws. In embodiments, cable insert fasteners 26 may have a diameter of 3 mm (i.e., M3 bolts).

In embodiments, upper and lower bodies 6 and 8, which securely encase cable insert halves 4, may be coupled together onto cable 14. Coupling of upper and lower bodies 6 and 8 onto cable 14 may be accomplished via dowel pins 36 and dowel pin recesses 38. In embodiments, dowel pin recesses 38, configured to receive dowel pins 36, may be disposed on inner surface 32 of both upper and lower bodies 6 and 8. In embodiments, one dowel pin 36 may correspond to two dowel pin recesses 38, one recess being disposed on inner surface 32 of upper body 6 and the other recess being disposed on inner surface 32 of lower body 8. As illustrated in FIGS. 2A and 2B, upper body 6 and lower body 8 may each comprise four dowel pins recesses 38 to receive four dowel pins 36. In embodiments, dowel pins 36 may be 4×8 mm pins. In an alternative embodiment, upper body 6 or lower body 8 may be machined to include pegs acting as dowel pins 36 that are received by corresponding recesses 38 disposed on the opposing body.

In addition to dowel pins 36 and dowel pin recesses 38, coupling of upper and lower bodies 6 and 8 may be accomplished via clamping bolts 40, clamping bolt female threads 42, and clamping bolt clearance holes 44. In embodiments, clamping bolt female threads 42 may be disposed on upper body 6 or lower body 8 with corresponding clamping bolt clearance holes 44 disposed on the opposing body relative to clamping bolt female threads 42. For instance, as illustrated on FIGS. 2A and 2B, clamping bolt female threads 42 may be disposed on inner surface 32 of lower body 8 and have corresponding clamping bolt clearance holes 44 disposed on upper body 6. In embodiments, clamping bolt clearance holes 44 may extend from inner surface 32 to outer surface 34. Upper body 6 or lower body 8 may comprise four clamping bolt female threads 42 or four clamping bolt clearance holes 44, or any combinations thereof. In embodiments, clamping bolts 40 may travel through clamping bolt clearance holes 44 and may be received by or fit into clamping bolt female threads 42, such that upper and lower bodies 6 and 8, along with cable insert halves 4, may be securely coupled and clamped onto cable 14. During installation, clamping bolts 40 may be torqued to a consistently safe limit with a calibrated torque wrench which in turn may reduce the risk of damage to cable 14 from cable insert halves 4 when clamping bolts 40 may be tightened. In embodiments, clamping bolts 40 may be any suitable fasteners, bolts, or screws such as, without limitation, four large cap head bolts or screws. In embodiments, clamping bolts 40 may have a diameter of 6 mm (i.e., M6 bolts).

In further embodiments, upper body 6 and lower body 8 may comprise lanyard holes 62 disposed on outer surface 34. Lanyard holes 62 may travel through one of the tapered portions of upper and lower bodies 6 and 8. As illustrated in FIGS. 2A and 2B, upper body 6 may comprise lanyard hole 62 and lower body 8 may comprise another lanyard hole 62. Lanyard holes 62 may be used to connect WCRO 2 to a lanyard during installation or removal onto cable 14 for added security and to avoid dropping the device down the wellbore.

The two opposing WCRO body halves, upper body 6 and lower body 8, may be manufactured from any suitable material such as, without limitation, stainless steel or other high-performance material. Further, upper and lower bodies 6 and 8 may also be surface hardened (e.g., vacuum hardened) to improve wear resistance during use. Further, upper and lower bodies 6 and 8 may be available in various sizes to accommodate the wellbore in which WCRO 2 may be used. In embodiments, the length of upper and lower bodies 6 and 8 may be between about 10.0 cm and about 15.0 cm, or alternatively between about 12.0 cm and about 13.0 cm. Further, the diameters of upper and lower bodies 6 and 8 may range from about 5.0 cm to 10.0 cm according to the application.

As set forth above, WCRO 2 may comprise two chassis 10 in addition to cable insert halves 4 and upper and lower bodies 6 and 8. In embodiments, each chassis 10 may be in the general shape of a hollow, half cylinder comprising a plurality of roller wheels 13 and chassis bolt clearance holes 56. In embodiments, each chassis 10 may be disposed on outer surfaces 34 of upper and lower bodies 6 and 8 in a reciprocal fashion. Further, each chassis 10 may comprise three roller wheels 13 phased at a 60° offset in an up/down pattern about the structure. In embodiments, outer surface 34 of both upper and lower bodies 6 and 8 may comprise a chassis recess portion 46 configured in shape to accurately receive chassis 10. Chassis recess portion 46 may be disposed about the middle, non-tapered portion of upper and lower bodies 6 and 8. In embodiments, chassis recess portion 46 may be about 4.0 cm in length, measuring from one tapered portion to the other, and about 2.0 cm in thickness. Further, chassis recess portion 46 may comprise curved recesses 47 to create clearance for plurality of roller wheels 13. Clearance may aid in preventing any debris from becoming lodged in WCRO 2 during operation. In embodiments, outer surface 34 of upper and lower body 6 and 8 at chassis recess portions 46 may comprise both the insert fastener clearance holes 28 and chassis bolt female threads 48. Chassis bolt female threads 48 correspond to chassis bolt clearance holes 56. In certain embodiments, as illustrated in FIGS. 2A and 2B, each chassis recess portion 46 of upper body 6 and lower body 8 may comprise two insert fastener clearance holes 28 and three chassis bolt female threads 48.

In embodiments, chassis 10 may be secured within chassis recess portions 46 via chassis bolts 50, chassis bolt clearance holes 56, and chassis bolt female threads 48. Chassis bolts 50 may travel through chassis bolt clearance holes 56 and may be received by or fit into corresponding chassis bolt female threads 48. In embodiments, chassis bolts 50 may be any suitable fasteners, bolts, or screws such as, without limitation, small cap head bolts or screws. In embodiments, chassis bolts 50 may have a diameter of 4 mm (i.e., M4 bolts). In certain embodiments, as illustrated in FIGS. 2A and 2B, each chassis 10 may comprise three chassis bolt clearance holes 56 phased at a 60° offset about the structure. Upon full assembly, WCRO 2 may comprise six roller wheels 13 disposed about its circumference. In embodiments, plurality of rollers wheels 13 may be capable of rotating axially in relation to cable 14, thereby allowing WCRO 2 to function as an omni wheel. For instance, WCRO 2 may be capable of moving both circumferentially and axially about an inner surface of a wellbore.

Figure 3A:
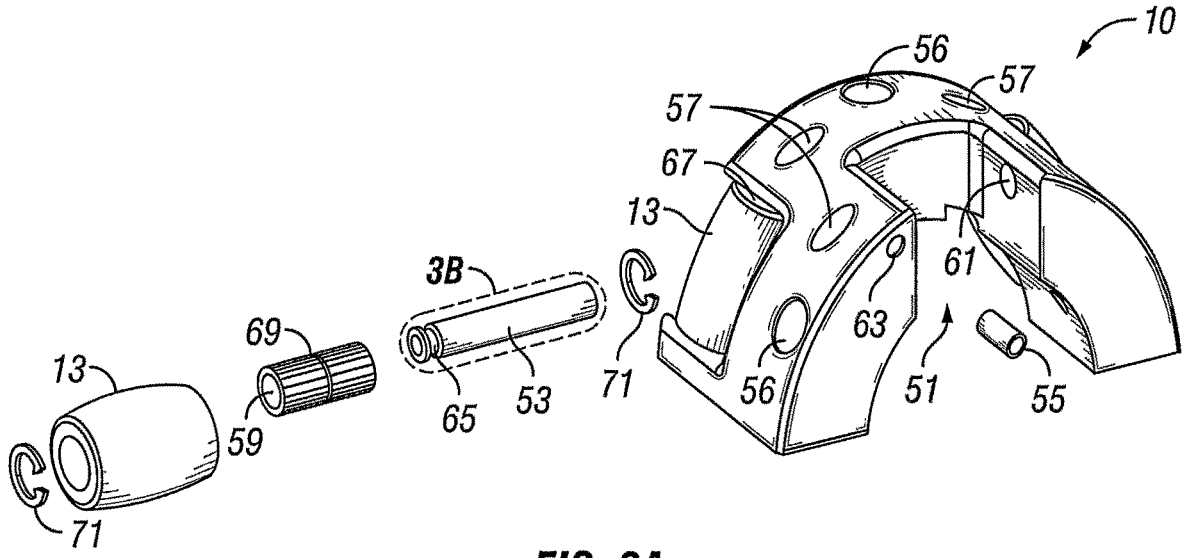
FIG. 3A illustrates a chassis with exploded roller wheel components in accordance with one embodiment of the present invention.

FIG. 3A illustrates chassis 10 of WCRO 2 comprising plurality of roller wheels 13 mounted to the structure, one of which is shown from an exploded perspective. Each roller wheel 13 may be mounted in a slot 51 of chassis 10 via an axle 53 and an axle fixing grub screw 55. In embodiments, axle 53 may be run through an axle clearance hole 57 disposed on chassis 10 and through a central bore 59 of each roller wheel 13, to rest in axle recess 61. Axle 53 may be about 4.0 cm in length and have an outer diameter of about 0.5 cm. To hold axle 53 in position, axle fixing grub screw 55 may be a fastener screwed through axle fixing pin threading 63 and clamped onto a groove 65 of axle 53. Once properly mounted and secured, each roller wheel 13 may be capable of rotating about axle 53 with a small clearance 67 of about 1 mm present between the external surface of each roller wheel 13 and the surfaces of chassis 10 about slot 51. Each roller wheel 13 may be about 2 cm in length, have a varying outer diameter ranging from about 14.0 mm and about 25.0 mm, and have an inner diameter of about 8.0 mm. In embodiments, a bearing 69 may be disposed within each roller wheel 13 and held in place via circlips 71. Bearing 69 may be any suitable bearing including, without limitation, a needle bearing. In embodiments, bearing 69 may be about 8.0 mm in length, have an outer diameter of about 8.0 mm, and have an inner diameter of about 5.0 mm. Further, bearing 69 may comprise multiple bearings if necessary (e.g., two needle bearings). Circlips 71 may be any suitable fasteners or retaining rings capable of holding bearing 69 in position within each roller wheel 13 and further, may be manufactured from a semi-flexible metal with open ends that may be snapped into place. In embodiments, to facilitate rotation of plurality of roller wheels 13 during operation, lubrication may be applied within each roller wheel 13.

Figure 3B:
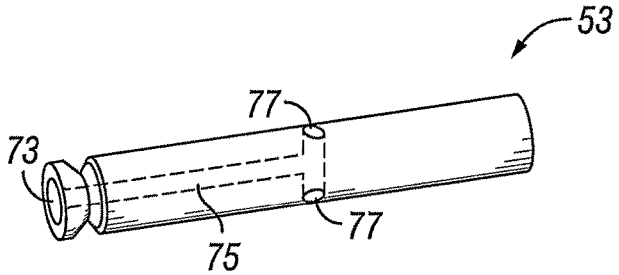
FIG. 3B illustrates a close-up, internal view of an axle in accordance with one embodiment of the present invention.

In embodiments, lubrication of plurality of roller wheels 13 may be accomplished via axle 53. FIG. 3B illustrates a close-up, internal view of axle 53 comprising a lubrication injection port 73, a lubrication channel 75, and a lubrication outlet 77. Prior to operation, a grease gun may be utilized and positioned at lubrication injection port 73 to pump any suitable lubricant (e.g., grease) through lubrication channel 75 and out lubrication outlet 77. In embodiments, lubrication outlet 77 may comprise one or more outlets (e.g., two outlets). As such, the lubricant may be provided to plurality of roller wheels 13 and bearings 69 and thus facilitate rotation during operation. In embodiments, plurality of wheels 13 may be properly lubricated when the lubricant appears at the ends of each roller wheel 13. Further, in embodiments, lubrication injection port 73 may be conically-shaped in order to properly seat the grease gun during injection of the lubricant.

In embodiments, chassis 10 of WCRO 2 as well as plurality of roller wheels 13 may be manufactured from any suitable material such as, without limitation, stainless steel. The use of stainless steel material for these components may contribute to durability of WCRO 2 during operation. Further during operation, plurality of roller wheels 13 may contribute to low friction of cable 14, therefore minimizing cable drag within a wellbore, reducing logging tensions, and improving force transmission during wireline logging operations. In embodiments, chassis 10 may have any suitable dimensions to allow for proper mounting of plurality of roller wheels 13 as well as proper seating into chassis recess portion 46.

When fully assembled, referring once again to FIGS. 1A and 1B, WCRO 2 may have an outer diameter of about 5.0 cm or greater (measured from the tip of one roller wheel 13 to another). In embodiments, WCRO 2 may have an outer diameter measuring about 7.4 cm. WCRO 2 may minimize contact area within the wellbore during logging operations and allow for standoff rotation under the action of cable torque. WCRO 2 allows for easy rotation, both axial and radial, should cable 14 rotate when it is deployed and retrieved from the wellbore. The general nature of a wireline or slickline cable during logging operations is to rotate. Rotation may be caused by opposing lay angles of inner and outer armors and induce unequal torsional forces when tensions are applied. As such, the design of WCRO 2 may allow for easy rotation of cable 14 during logging operations, avoiding, for example, the potential for damage if excessive torque was allowed to build up.

In further embodiments upon full assembly, WCRO 2 may comprise cutouts 54. Sometimes during the disassembly or removal of WCRO 2 from cable 14, WCRO 2 may become stuck or fixed to the wireline or slickline. In such case, a parting tool or special jig may be used to pry WCRO 2 from cable 14. In embodiments, the parting tool may utilize cutouts 54 disposed on inner surface 34 of upper and lower bodies 6 and 8 to achieve leverage when disengaging a stuck WCRO 2 from cable 14.

Figure 4A:
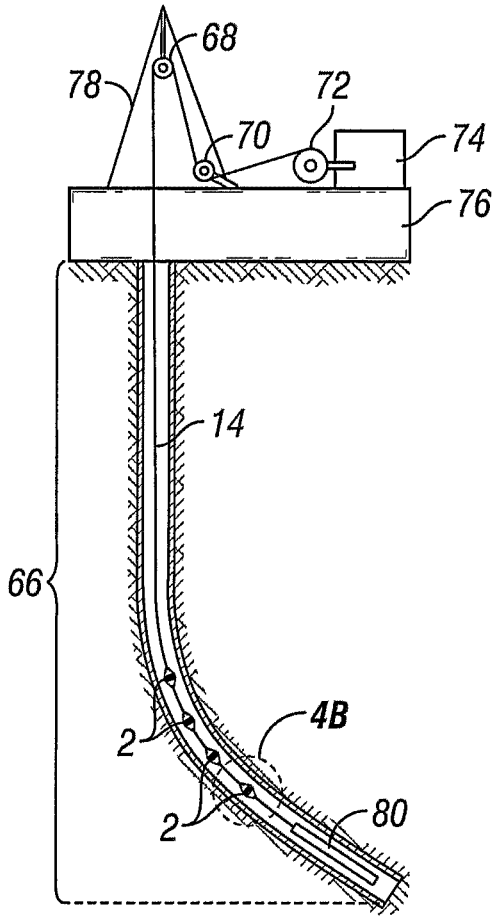
FIG. 4A illustrates a plurality of wireline cased-hole rollers installed on a wireline cable in accordance with one embodiment of the present invention.
Figure 4B:
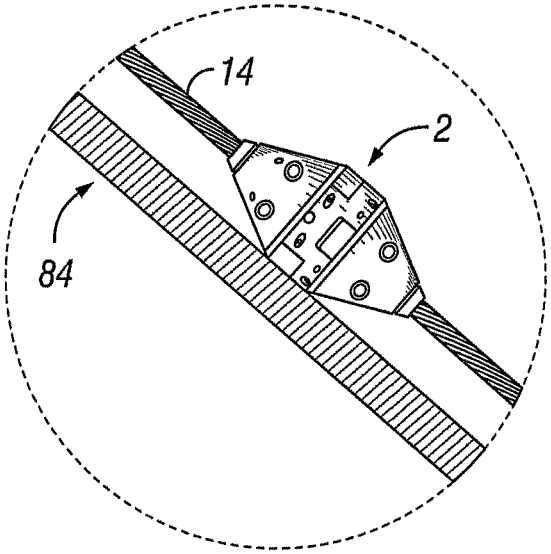
FIG. 4B illustrates a close-up view of a wireline cased-hole roller in relation to a wellbore wall in accordance with one embodiment of the present invention.

FIG. 4A illustrates a generic logging operation that includes a plurality of WCROs 2 coupled to cable 14 in accordance with one embodiment of the present invention. As illustrated, plurality of WCROs 2 may be clamped onto cable 14. Cable 14 may be, for example, stored on a wireline drum 72 and spooled into the well by a winch driver and logging engineer in a logging unit 74. In the illustrated embodiment, logging unit 74 may be fixed to the drilling rig or platform 76, and cable 14 may be deployed through a derrick 78 via at least two sheaves such as an upper sheave 68 and a lower sheave 70 to the maximum depth of the wellbore. The wellbore may be a cased well with cased-hole portion 66. As illustrated, WCROs 2 may be installed on cable 14 in cased-hole portion 66. A logging tool 80 may be connected to the lower end of cable 14 to take, for example, measurements involving the state of tubing, casing, cement, or perforations of the wellbore. The number of WCROs 2, and their positions on cable 14 may be determined by a number of factors, including for example, the length of the cased-hole portion 66, the location at which logging tool 80 needs to reach, and the overall trajectory of the wellbore, which may be deviated or directional in nature. In embodiments, WCROs 2 may be deployed at any suitable distance above a logging tool such that they remain within a casing portion and reduce the drag in that portion. This in turn may permit more pull-down for open-hole tools. Further, WCROs 2 may be used in addition to other cable standoff-type devices. FIG. 4B illustrates a close-up view of a single WCRO 2 attachment to cable 14 taken along circle 82. In the illustration of FIG. 4B, WCRO 2 may be seen in relation to cable 14, a wellbore wall 84, and the wellbore.

In embodiments in which plurality of WCROs 2 may be used on cable 14, high tension and high drag during wireline logging operations may be significantly reduced by minimizing cable 14 contact over a selected zone(s) of a wellbore. WCROs 2 may be installed on cable 14, for example, to either straddle known dogleg zones where the cutting of casing grooves may be a risk (e.g., eliminating cable contact 100%) or they can be placed at regular intervals along cable 14 to minimize friction, and therefore reduce tension, during logging operations of the wellbore. In certain embodiments, the spacing of WCROs 2 on cable 14 may be from about 3 meters to about more than 35 meters, depending on the requirements for the particular wellbore being logged.

Although the present invention and its advantages have been described in detail, it should be understood that various changes, substitutions and alterations may be made herein without departing from the spirit and scope of the invention as defined by the appended claims.

What is claimed is:

1. A wireline cased-hole roller (WCRO) comprising:

a pair of cable insert halves;

a pair of opposing WCRO body halves;

a pair of reciprocally-positioned chassis each comprising a plurality of roller wheels; and one or more fasteners, wherein the one or more fasteners are configured to couple the pair of cable insert halves, the pair of opposing WCRO body halves, and the pair of chassis together onto a cable, wherein each of the pair of chassis are secured within a corresponding recessed portion of each of the opposing WCRO body halves;

wherein the shape of the WCRO in combination with the plurality of roller wheels allow for both radial and axial movement, wherein each of the plurality of roller wheels are mounted to the pair of chassis via an axle, wherein the axle is run through an axle clearance hole disposed on the chassis and through a central bore of each roller wheel, to rest in an axle recess.

2. The WCRO of claim 1, wherein each axle is held in position via an axle fixing pin, wherein the axle fixing pin is screwed through an axle fixing pin threading disposed on the chassis and clamped to a groove disposed on the axle.

3. The WCRO of claim 2, wherein each axle comprises a lubrication injection port, a lubrication channel, and a lubrication outlet, wherein a lubricant is injected into each axle at the lubrication injection point, through the lubrication channel, and out the lubrication outlet to facilitate rotation of the plurality of roller wheels.

* * * * *